US007337782B2

(12) United States Patent
Thompson

(10) Patent No.: US 7,337,782 B2
(45) Date of Patent: Mar. 4, 2008

(54) PROCESS TO REMOVE PROTEIN AND OTHER BIOMOLECULES FROM TOBACCO EXTRACT OR SLURRY

(75) Inventor: Bruce T. Thompson, Macon, GA (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 524 days.

(21) Appl. No.: 10/920,468

(22) Filed: Aug. 18, 2004

(65) Prior Publication Data

US 2006/0037620 A1 Feb. 23, 2006

(51) Int. Cl.
*A24B 15/00* (2006.01)

(52) U.S. Cl. ..... 131/297; 131/298; 131/309; 131/310

(58) Field of Classification Search ..... 131/297, 131/298, 300, 309, 310, 356, 357
See application file for complete search history.

(56) References Cited

U.S. PATENT DOCUMENTS

| | | | | |
|---|---|---|---|---|
| 3,969,336 A | | 7/1976 | Criswell | |
| 5,122,267 A | | 6/1992 | Giovanetti et al. | |
| 5,311,886 A | * | 5/1994 | De Grandpre et al. | 131/297 |
| 5,377,698 A | * | 1/1995 | Litzinger et al. | 131/370 |
| 5,601,097 A | * | 2/1997 | De Grandpre et al. | 131/297 |
| 5,629,424 A | | 5/1997 | Armstrong et al. | |
| 5,715,844 A | * | 2/1998 | Young et al. | 131/374 |
| 5,765,570 A | * | 6/1998 | Litzinger et al. | 131/370 |
| 5,951,875 A | | 9/1999 | Kanel et al. | |
| 5,961,831 A | | 10/1999 | Lee et al. | |
| 6,436,295 B2 | | 8/2002 | Kim | |
| 6,508,254 B1 | * | 1/2003 | Conway et al. | 131/297 |

FOREIGN PATENT DOCUMENTS

| | | | |
|---|---|---|---|
| SU | 1839089 A1 | * | 12/1993 |
| WO | 9828082 | | 7/1998 |

OTHER PUBLICATIONS

Ko, Porkop and Tanner; Effect of pH on Successive Foam and Sonic Droplet Fractionation of a Bromelain-invertase Mixture; Biotechnol. Bioprocess Eng.; 2002; pp. 26-30; vol. 7, No. 1; Korean Society for Biotechnology and Bioengineering; South Korea.

(Continued)

*Primary Examiner*—Carlos Lopez
(74) *Attorney, Agent, or Firm*—Charles I. Sherman; Middleton Reutlinger

(57) ABSTRACT

A process is disclosed for removing proteins and other undesirable biomolecules from tobacco extract or slurry via foam fractionation, thereby concentrating the tobacco extract or slurry. The tobacco extract or slurry is treated and modified prior to being subjected to the foam fractionation to enhance the extent and efficiency of protein removal. After foam fractionation, the concentrated extract, sans proteins and other Hoffman analyte precursors, is applied to a tobacco sheet material, and the collected foam can be recirculated through foam fractionation for enhanced concentration.

36 Claims, 10 Drawing Sheets

OTHER PUBLICATIONS

Darton, Supino and Tanner; Development of a Multistaged Foam Fractionation Column; Chemical Engineering and Processing; 2004; pp. 477-482; vol. 43; Elsevier Science.

Uraizee and Narsimhan; A Model for Continuous Foam Concentration of Proteins: Effects of Kinetics of Adsorption of Proteins and Coalescence of Foam; Separation Science and Technology; 1995; pp. 847-881; vol. 30; Marcel Dekker Inc.; USA.

Jashnani and, Lemlich; Foam Drainage, Surface Viscosity, and Bubble Size Bias; Journal of Colloid and Interface Science; Jan. 1974; pp. 13-16; vol. 46, No. 1; Academic Press Inc.; USA.

Robert Lemlich; Some Physical Aspects of Foam; Journal of Society Cosmetic Chemists; May 23, 1972; pp. 299-311; vol. 23; USA.

Lockwood, Kim, Bummer and, Jay; Scintigraphic Measurement of Liquid Holdup in Foam Fractional Columns; Journal of Colloid and Interface Science; Mar. 13, 2000; pp. 24-31; vol. 227; Academic Press Inc.; USA.

Lucena, Miranda and, Santana; The Effect of External Reflux on the Foam Fractionation of Proteins; Applied Biochemistry and Biotechnology; 1996; vol. 57/58; Humana Press Inc; USA.

Chen, Timmons, Bisogni Jr, and Aneshansley; Modeling Surfactant Removal in Foam Fractionation: II—Experimental Investigations; Aquacultural Engineering; Apr. 30, 1993; vol. 13; Elsevier Science Limited; Great Britain.

Chiang, Iibuchi, and Yano; Single- and Multi-component Adsorption Equilibria in Bubble Separation of Organic Materials; Agric. Biol. Chem.; 1980; Pates 1803-1809; vol. 44, No. 8.

Keirstead and, Caverhill; Surface Activity of Foam Fractions of a Calcium Lignosulphonate; The Canadian Journal of Chemical Engineering; Oct. 1982; pp. 680-683; vol. 60; Canada.

Banerjee, Agnihotri and Bhattacharyya; Purification of Alkaline Protease of *Rhizopus Oryzae* by Foam Fractionation; Bioprocess Engineering; 1993; pp. 245-248; vol. 9; Springer-Verlag; India.

Robert Lemlich; Adsubble Processes: Foam Fractionation and Bubble Fractionation; Journal of Geophysical Research; Sep. 20, 1972; pp. 5204-5210; vol. 77, No. 27; American Geophysical Union; USA.

Jirawat, Loha, Prokop and Tanner; Batch Foam Fractionation of Kudzu (*Pueraria lobata*) Vine Retting Solution; 1998; pp. 558-567; vol. 70-72; Applied Biochemistry and Biotechnology; Humana Press Inc.; USA.

Du, Prokop and Tanner; Variation of Bubble Size Distribution in a Protein Foam Fractionation Column Measured Using a Capillary Probe With photoelectric Sensors; Journal of Colloid and Interface Science; 2003; pp. 180-185; vol. 259; Elsevier Science; USA.

Chai, Loha, Prokop and Tanner; Effect of Bubble Velocity and pH Step Changes on the Foam Fractionation of Sporamin; J. Agric. Food. Chem.; 1998; pp. 2868-2872; vol. 46; American Chemical Society; USA.

Lambert, Du, Ma, Loha, Burapatana, Prokop, Tanner and Pamment; The Effect of pH on the Foam Fractionation of B-glucosidase and Cellulase; Bioresource Technology; 2003; pp. 247-254; vol. 87; Elsevier Science Ltd.; USA.

Montero, Kirschner and Tanner; Bubble and Foam Concentration of Cellulase; Applied Biochemistry and Biotechnology; 1993; pp. 467-475; vol. 39-40; Humana Press Inc.; USA.

Ko, Cherry, Prokop, and Tanner; Effect of a Natural Contaminant on Foam Fractionation of Bromelain; Applied Biochemistry and Biotechnology; 2001; vol. 91-93; Humana Press Inc.; USA.

Burapatana, Butler, Chauhan, Hartig, Kincaid, Wang, Samsudin and Tanner; Effect of Lidocaine on Ovalbumin and Egg Albumin Foam Stability; Applied Biochemistry and Biotechnology; May 6, 2003; pp. 905-911; vol. 105-108; Humana Press Inc.; USA.

Neely, Eiamwat, Du, Loha, Prokop and Tanner; Modeling a Batch Foam Fractionation Process; Biologia, Bratislava, Section on Cellular and Molecular Biology; 2001; pp. 583-589; vol. 56, No. 6; USA.

Noel, Prokop and Tanner; Foam Fractionation of fa Dilute Solution of Bovine Lactoferrin; Applied Biochemistry and Biotechnology; 2002; pp. 395-401; vol. 98-100; Humana Press Inc.; USA.

Prokop and Tanner; Foam Fractionation of Proteins: Potential for Separations from Dilute Starch Suspensions; 1993; pp. 150-154; vol. 45; VCH Verlagsgesellschaft mbH; Weinheim.

Farooq Uraizee and Ganesan Narsimhan; Effects of Knetics of Adsorption and Coalescence on Continuous Foam Concentration of Proteins: Comparison of Experimental Results with Model Predictions; Biotechnology and Bioengineering; Aug. 20, 1996; pp. 385-398; vol. 51, No. 4; John Wiley & Sons, Inc; USA.

Christopher Lockwood, Paul Bummer, and Michael Jay; Purification of Proteins Using Foam Fractionation; Pharmaceutical Research; Aug. 13, 1997; pp. 1511-1515, vol. 14, No. 11; Plenum Publishing Corporation; USA.

Crofcheck, Loiselle, Weekley, Maiti, Pattanaik, Bummer and, Jay; Histidine Tagged Protein Recovery from Tobacco Extract by Foam Fractionation; Biotechnol. Prog.; Feb. 20, 2003; pp. 680-682; vol. 19, No. 2; American Chemical Society and American Institute of Chemical Engineers; USA.

Mohan and Lyddiatt; Protein Separation by Differential Drainage from Foam; Biotechnology and Bioengineering; Jul. 17, 1994; pp. 1261-1264; vol. 44, No. 10; John Wiley & Sons Inc.; United Kingdom.

Chen, Timmons, Aneshansley and, Bisogni Jr; Bubble Size Distribution in a Bubble Column Applied to Aquaculture Systems; Aquacultural Engineering; Aug. 28, 1992; pp. 267-280; vol. 11; Elsevier Science Publishers Ltd; Great Britain.

Weaire, Hutzler, Cox, Kern, Alonso and Drenckhan; The Fluid Dynamics of Foams; Journal of Physics: Condensed Matter; Dec. 16, 2002; pp. S65-S73; vol. 15; Institute of Physics Publishing Ltd; United Kindgom.

Hussenot, Lefebyvre and, Broassard; Open-air Treatment of Wastewater from Land-based Marine Fish Farms in Extensive Systems: Current Technology and Future Perspectives; Aquat. Living Resour.; Feb. 11, 1998; pp. 297-304; vol. 11, No. 4; Infremer/Elsevier; Paris.

Loha; Tanner and Prokop; The Effect of Pectinase on the Bubble Fractionation of Invertase from a-Amylase; Applied Biochemistry and Biotechnology; 1997; pp. 395-408; vol. 63-35; Humana Press Inc.; USA.

Ko, Loha, Prokop and Tanner; Batch Foam Recovery of Sporamin from Sweet Potato; Applied Biochemistry and Biotechnology; 1998; pp. 547-558; vol. 70-72; Humana Press Inc.; USA.

Brown, Narsimhan and Wankat; Foam Fractionation of Globular Proteins; Biotechnology and Bioengineering; Nov. 1990; pp. 947-959; vol. 36; John Wiley & Sons Inc.; USA.

Bhattacharya, Ghosal and Sen; Effect of Physicochemical Parameters on the Separation of Proteins from Human Placental Extract by Using a Continuous Foam Fractionating Column; Separation Science and Technology; 1991; pp. 1279-1293; vol. 26; Marcel Dekker Inc.; USA.

Uraizee and Narsimham; Foam Fractionation of Proteins and Enzymes: I. Applications; Enzyme Microb. Technol.; Mar. 1990; pp. 232-233; vol. 12; Butterworth Publishers; USA.

Uraizee and Narsimham; Foam Fractionation of Proteins and Enzymes: II. Performance and Modelling: Enzyme Microb. Technol.; Apr. 1990; pp. 315-316; vol. 12; Butterworth Publishers; USA.

Foam Fractionation: The Ins and Outs; http://home.mweb.co.za/jv/jv79/reef/foamfrac.html, date unknown.

Commercial Foam Fractionators; http://www.emperoraquqtics.com/new-commfoamfrac.html; Emperor Aquatics, Inc, date unknown.

Du, Loha and Tanner; Modeling a Protein Foam Fractionation Process; 2000; vol. 84-86; Applied Biochemistry and Biotechnology; Humana Press Inc.; USA.

Du, Ding, Prokop and Tanner; Measurement of Bubble Size Distribution in Protein Foam Fractionation Column Using Capillary Probe with Photoelectric Sensors; 2001; pp. 387-404; vol. 91-93; Applied Biochemistry and Biotechnology; Humana Press Inc.;USA.

Du, Ding, Prokop and Tanner; Preserving the Activity of Cellulase in a Batch Foam Fractionation Process; 1999; pp. 701-712; vol. 77-79; Applied Biochemistry and Biotechnology; Humana Press Inc.; USA.

Landau; Richard and Erstfeld; The Effect of Suspended Clay on Protein Removal During foam Fractionation; North American Journal of Aquaculture; Jan. 24, 2002; pp. 217 and 219; vol. 64; American Fisheries Society; USA.

Wenzig; Lingg; Kerzel; Zeh and Mersmann; Comparison of Selected Methods for Downstream Processing in the Production of Bacterial Lipase; Chem. Eng. Technol; 1993; pp. 405-412; vol. 16; VHC Verlagsgesellschaft mbH; Weinheim.

Karl Keirstead; Surface Tension and Gas Permeability Data for Soluble Lignins and an Air-Liquid Interface; Colloid and Interface Science; 1976; pp. 431-442;vol. III; Academic Press Inc.; USA.

Crofcheck, Jay and Bummer; Improved Recovery of Engineered Pharmaceutical Proteins from Tobacco Plant Extract; USA, date unknown.

Ackermann, Stedman, Ko, Prokop, Park and Tanner; Effect of invertase on the Batch Foam Fractionation of Bromelain; Biotechnology and Bioprocess Engineering; Jun. 2, 2003; pp. 167-172; vol. 8; KSBB; USA.

Parlar, Gschwendtner, Anschutz, Leupold and Gorg; Influence of Selected Parameters on the Isoelectric Adsorptive Bubble Separation (IABS) of Potato Proteins; Advances in Food Sciences; Mar. 15, 2001; pp. 2-10; vol. 23; PSP; Germany.

Phianmongkhol and Varley; Potential Measurement for Air Bubles in Protein; Journal of Colloid and Interface Science; Jan. 15, 2003; pp. 332-338; vol. 260; Elsevier Science; USA.

Thondavadi and Lemlich; Flow Properties of Foam with and without Solid Particles; Ind. Eng. Chem. Process Des. Dev.; Oct. 23, 1984; pp. 748-753; vol. 24, No. 3; USA.

Webb, Page, Jay and Bummer; Characterization and Validation of the Gamma-scintigraphic Method for Determining Liquid Holdup in Foam; Applied Radiation and Isotopes; 2002; pp. 243-255; vol. 57; Elsevier Science; USA.

Loockwood, Jay and Bummer; Foam Fractionation of Binary Mixtures of Lysozyme and Albumin; Journal of Pharmaceutical Sciences; Jun. 2000; pp. 693-704; vol. 89, No. 6; Wiley-Liss Inc. and the American Pharmaceutical Association; USA.

Tanner, Parker, Ko, Ding, Loha, Du and Prokop; Effect of Protein Denaturation on Void Fraction in Foam Separation Column; 2000; vol. 84-86.

* cited by examiner

PROCESS TO REMOVE PROTEIN AND OTHER BIOMOLECULES FROM TOBACCO EXTRACT OR SLURRY

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENTIAL LISTING," A TABLE, OR A COMPUTER PROGRAM LISTING APPENDIX SUBMITTED ON A COMPACT DISC

Not applicable.

BACKGROUND OF THE INVENTION

1. Field of the Invention

The present invention relates to a method of using foam fractionation to remove proteins and other undesirable molecules from aqueous tobacco extract. More particularly, the present invention relates to a method of treating and modifying aqueous tobacco extract to enhance the extent and efficiency of the removal of proteins and other undesirable molecules from aqueous tobacco extract.

2. Description of the Related Art

Adsorptive bubble separation techniques, also known as foam fractionation, for separating and removing soluble compounds, are known in the art. The techniques have been applied to the separation of proteins, ions, metals, surfactants, and other particles such as activated carbons, clays, and plastics. For example, U.S. Pat. No. 5,653,867, issued to Jody, et al., teaches a method for separating acrylonitrile butadiene styrene (ABS) plastics from high impact polystyrene (HIPS). The extent and efficiency of separation are enhanced by selectively modifying the effective density of the HIPS using a solution having the appropriate density, surface tension, and pH, such as acetic acid and water or hydrochloric acid, salt, surfactant, and water. Further, U.S. Pat. No. 5,629,424, issued to Armstrong, et al., teaches an adsorptive bubble separation process, whereby a solution of optically active isomers and a chiral collector having a chiral center and a structure capable of interacting with an enantiomer or a diastereomer is formed, and a gas is bubbled through the solution to form bubbles having the chiral collector and the enantiomer or diastereomer adsorbed thereto. The bubbles are collected and allowed to collapse to form a liquid fraction separate from the solution, thereby producing an enriched concentration of the enantiomer or diastereomer. Also, U.S. Pat. No. 3,969,336, issued to Criswell, teaches a method of separating and concentrating soluble proteins from a whey protein solution via foam fractionation, and U.S. Pat. No. 5,951,875 and PCT WO 98/28082, both issued to Kanel, et al., teach a system for dewatering (i.e., concentrating) ruptured algal cells via adsorptive bubble separation techniques.

Thus, a process is needed to remove soluble proteins from aqueous tobacco extract via foam fractionation, combined with the treatment and/or modification of the tobacco extract to enhance the extent and efficiency of chemical removal, and further combined with the application of the resultant treated tobacco extract to tobacco sheet material.

SUMMARY OF THE INVENTION

The instant invention provides a process for the removal of soluble proteins and other biomolecules, combined with modification of the extract conditions (e.g., pH, temperature, and/or ionic strength) or treatment of the extract (e.g., adjusting pH and/or adding chelates, activated charcoals, clays, ion exchange resins, molecular imprinted polymers, and/or surfactants) to enhance the extent and efficiency of protein and biomolecule separation from the tobacco extract, further combined with the application of the resultant modified and/or treated tobacco extract to tobacco sheet material. Reducing the level of proteins in paper reconstituted tobacco will reduce the total Hoffman analyte delivery when the treated reconstituted tobacco is incorporated into the blend.

Generally, foam fractionation is the process of separating and concentrating chemicals, colloids, and other species that exhibit air-liquid surface activity. The air-liquid surface activity of proteins is well-recognized. Certain classes of chemicals are removed or degraded in this aqueous tobacco extract by entraining a gas or gas mixture (e.g., air, nitrogen, ozone, oxygen, or ammonia) with a diffuser or aspirator and separating the resulting foam using a foam fractionation system. The foam may also be generated by agitation. Surface active components of the solution absorb to the surface (i.e., the gas-liquid interface) of the foam bubbles as the foam bubbles move through the liquid. The bubbles leave the surface of the liquid forming a foam column, and the surface active components are removed with the foamate.

Two important characteristics of the foam are the large gas-liquid interfacial area and the interstitial liquid. As the foam height increases, the interstitial liquid drains slowly through the foam's lamella, removing soluble non-adsorbing species and concentrating the surface active species. As the liquid drains, the lamella becomes thinner and gas diffusion increases between the bubbles. Eventually, the foam collapses yielding foamate enriched with the surface active species.

Two approaches enhance the extent and efficiency of chemical removal. First, the extraction conditions can be modified, such as by changing the pH, temperature, or ionic strength, to increase extraction of non-water soluble components of tobacco. Second, the extraction can be treated, such as with chelates, activated charcoal, clays, ion exchange resins, molecular imprinted polymers, and/or surfactants, to enhance the adsorption of a particular chemical or chemical class. The resultant treated tobacco extract would then be applied to tobacco sheet material in accordance with practice known in the art. The tobacco can be refined to the level where it can be slurried and processed in the foam fractionation system, wherein the treated slurry could be combined with other additives and be cast and dried into a tobacco sheet in accordance with normal practice.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENTS

While this invention is susceptible of embodiments in many different forms, there are shown in the Figures and will herein be described in detail, preferred embodiments of the invention, with the understanding that the present disclosure is to be considered as an exemplification of the principles of the invention, and is not intended to limit the broad aspects of the invention to the embodiments illustrated.

Figure 1:
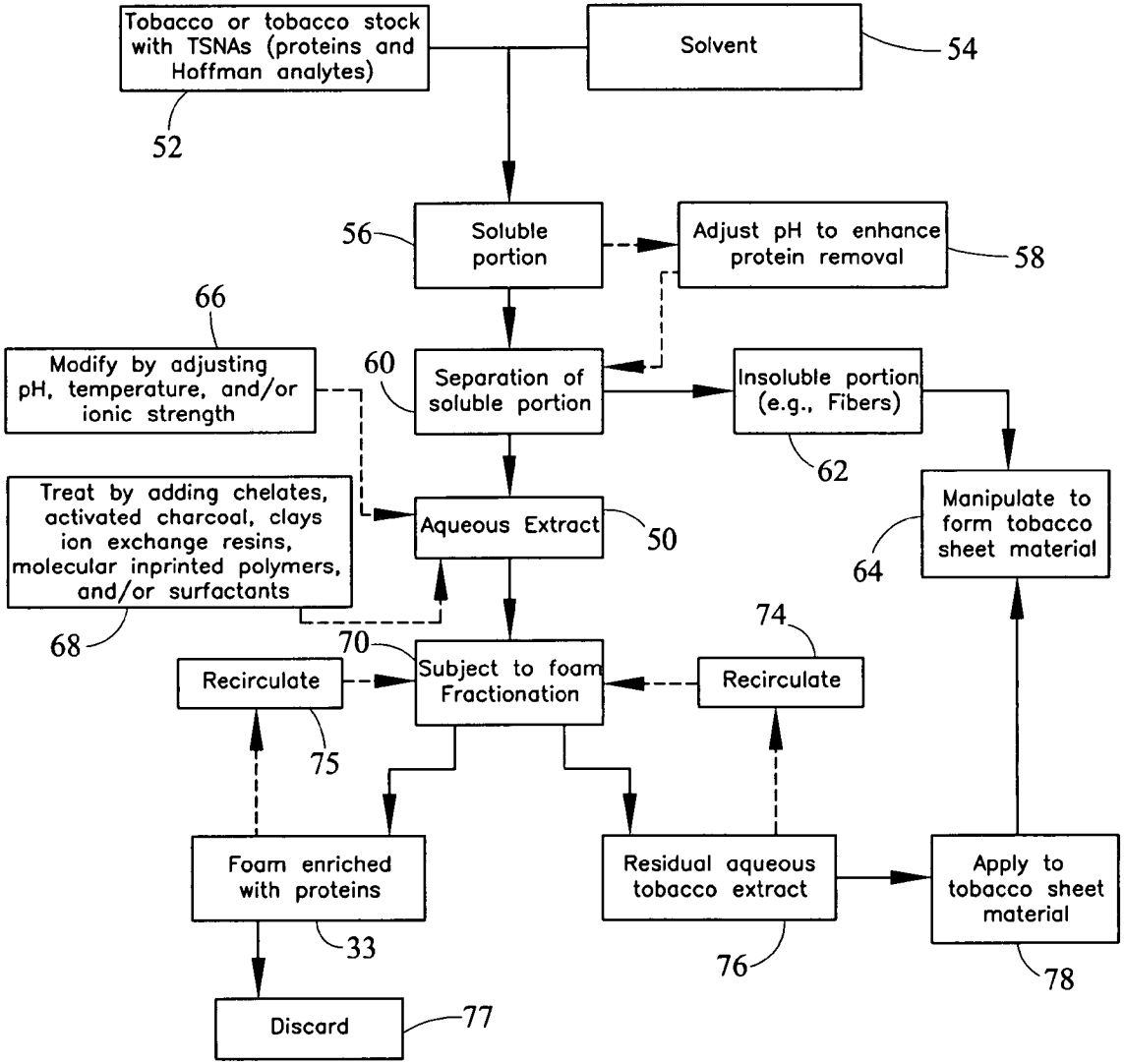
FIG. 1 is a flowchart of a method of the instant invention for reducing Hoffman analyte precursor content of tobacco via foam fractionation.

The instant invention is a novel method of reducing Hoffman analyte precursors, specifically proteins and other undesirable molecules, which can be implemented in the paper reconstituted tobacco process. Referring first to FIG. 1, utilizing a reconstituted tobacco paper making process, tobacco or tobacco stock 52 is soaked in a solvent 54, such as water, distilled water, tap water, deionized water, water-miscible solvents, and combinations thereof, to form a soluble portion (i.e., tobacco slurry) 56. The tobacco stock 52 maybe natural tobacco (e.g., tobacco stems, such as flue-cured stems, fines, tobacco byproducts), reconstituted tobacco, tobacco extracts, blends thereof, and other tobacco containing material. Optionally, to enhance protein removal, the pH 58 of the soluble portion 56 maybe adjusted in the range of from about 3 to about 10 using various inorganic acids or bases, such as HCl or KOH. The water (or aqueous) extract 50 is separated, for example via centrifugation 60, from the insoluble portion 62, which is comprised of mostly fibers. The insoluble portion 62 is manipulated to form a tobacco sheet material 64. However, from about 0.5% to about 10.0% by weight of dissolved solids may still remain in the aqueous extract 50.

Meanwhile, the conditions of the aqueous extract 50 maybe modified by favorably adjusting pH, temperature, and/or ionic strength 66. For example, the pH may be adjusted within the range of from about 3 to about 10 to enhance protein removal depending on various factors. Furthermore, the aqueous extract 50 may be treated by the addition of chelates, activated charcoals, clays, ion exchange resins, molecular imprinted polymers, and/or surfactants 68. Such modification and treatment serve to enhance the extent and efficiency of protein and biomolecule separation from a resultant treated aqueous tobacco extract 50.

Figure 2:
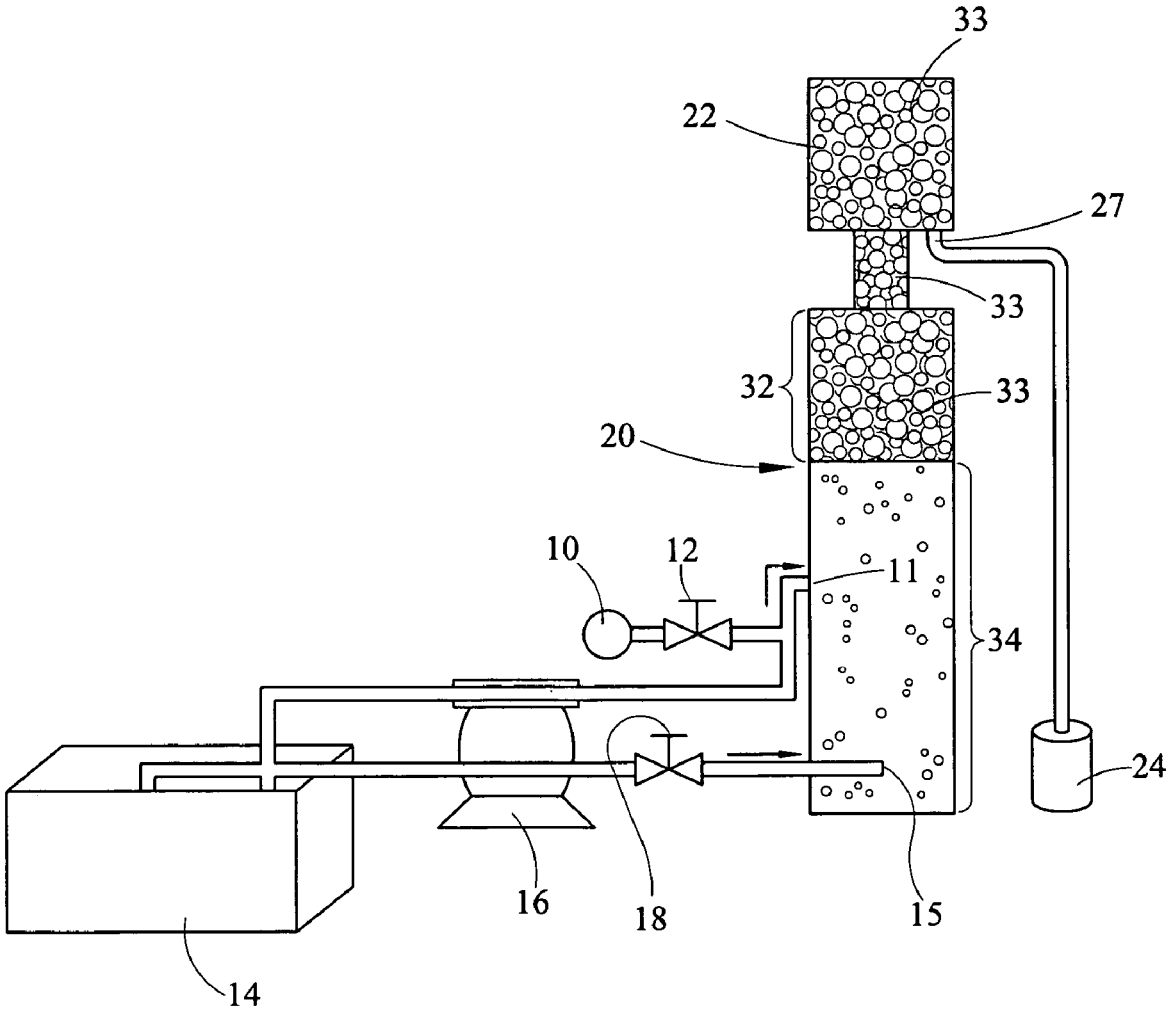
FIG. 2 is a schematic of the foam fractionation system.

Now also referring to FIG. 2, the resultant treated aqueous tobacco extract 50 in a tank 14 is subsequently processed and concentrated in the foam fractionation system 70, by removal of proteins and other undesirable molecules, such as clay, activated charcoal, MIPS, etc. The extract concentration (i.e., batch size) varies, and a more comprehensive description of preferable batch size is described in the Examples below. The aqueous tobacco extract 50 from the tank 14 enters a foam fractionator 20 at an extract entrance 15, the amount being regulated by a valve 18. The foam fractionator 20 may be one of many different embodiments. A gas supply 10 is provided by a pump 16 and an air valve 12 to regulate the amount of air flowing through the entrance 11 and into the foam fractionator 20. The gas can be air, nitrogen, ozone, oxygen, ammonia, or mixtures thereof. Foam may also be generated by injecting air or gas by a Venturi tube or via agitation. The air velocity and bubble size (related to volumetric air flow) can vary, and a more comprehensive description of preferable volumetric air flow rate is described in the Examples below.

The gas 10 bubbles through the aqueous tobacco extract 50. Surface active components of the aqueous tobacco extract 50, such as proteins and other undesirable biomolecules, adsorb to the gas-liquid interface of the bubbles as the bubbles move through the aqueous tobacco extract in the foam fractionator 20. The bubbles leave the surface of the aqueous tobacco extract liquid, forming a column of foam 33 on top of the aqueous tobacco extract. Extract pool height 34 and the foam height 32 are variables related to foam generation rates, and are described in more detail in the Examples. As the foam 33 height increases, the foam 33 enters a foam collector 22, in which the interstitial liquid drains slowly through the foam's lamella, removing soluble non-adsorbing species and concentrating the surface active species. As the liquid drains, the lamella becomes thinner and gas diffusion increases between the bubbles. The foam 33 eventually collapses, yielding a foamate enriched with the surface active species (i.e., proteins and other undesirable biomolecules.) The foamate flows through a foamate exit 27 into a foamate collector 24, to perhaps be discarded 77, or further concentrated by recirculation 75 through foam fractionation 70. This further recirculation may be either through the same foam fractionator or a series of foam fractionators in tandem.

The residual aqueous tobacco extract 76, having reduced protein content, may then be applied to tobacco sheet material 78, or recirculated 74 through foam fractionation 74. Simultaneously with recirculation 74, the residual aqueous tobacco extract 76 may be treated with chelates, activated charcoals, clays, ion exchange resins, molecular imprinted polymers, surfactants, and combinations thereof. Note that recirculation of the foamate and/or the residual aqueous tobacco extract may include recirculation in either the same foam fractionator or, preferably, a series or plurality of foam fractionators in tandem, which can each have their own unique settings and configurations (e.g., pH adjustments) to optimize protein removal at each subsequent foam fractionator.

A more comprehensive understanding of the invention can be obtained by considering the following Examples. However, it should be understood that the Examples are not intended to be unduly limitative of the invention.

EXAMPLE 1

A foam fractionator 20 (i.e., protein skimmer) used for this Example, from Emperor Aquatics, Inc. (Pottstown, Pa.) and similar to the example shown in FIG. 2, consisted of a foam collector on top of the main body, two injector valves, a counter flow by-pass, an inlet, and an outlet. Flow through the system was created by an external pump and controlled by a gate valve at the outlet. The amount of air injected, and thus the amount and quality of the foam generated, was controlled by a valve on the air inlet of the large injector, the liquid flow valve to the small injector, and the counter flow by-pass. The flow rate of air into the injector was set to 0.5 L/min.

Tobacco extract was prepared by extracting 10.4 kg of a 50/50 mix of flue-cured scrap tobacco (FS) and burley scrap tobacco (BS) in 113 L of water at 71° C. for 30 minutes. A typical full batch size would be about 10 kg of tobacco to about 100 L (i.e., about 100 kg) of water, having a tobacco to solvent ratio from about 1:100 to about 1:10. Tobacco may be soaked at optional temperatures ranging from about 63° C. to about 100° C., for at least about 30 minutes. The liquid was separated from the solid tobacco material with a basket centrifuge. The extract was recirculated through the foam fractionater and samples of the extract and foamate (i.e., collapsed foam) were collected every hour. The samples were analyzed for soluble proteins. The process was repeated three times.

Surface active components (e.g., soluble proteins) of the solution adsorb to the surface of the bubbles and are removed with the foam. The surface activity is determined by the degree of hydrophobicity of the molecule, colloid, complex, etc. Proteins prefer to be at the air/water surface of the bubbles and will be removed with the bubbles. Here, the proteins have hydrophobic side chains. These side chains are the driving force for a protein's conformation and adsorption to the bubble surface and removal by foam fractionation. Highly soluble compounds, like ions, have low surface activity unless complexed with a "collector" which facilitates removal. Most collector research has been applied to metals and use chelates or colloids to remove the metal ions by foam fractionation. Collectors for tobacco extract may also include activated charcoal, clays, ion exchange beads, molecular sieves, and molecular imprint polymers (which can be specific to a class of compounds, like tobacco specific nitrosamines). Colloids can be self-formed from biopolymers, like proteins and lignins, by reducing pH and/or temperature after caustic extraction.

Figure 3:
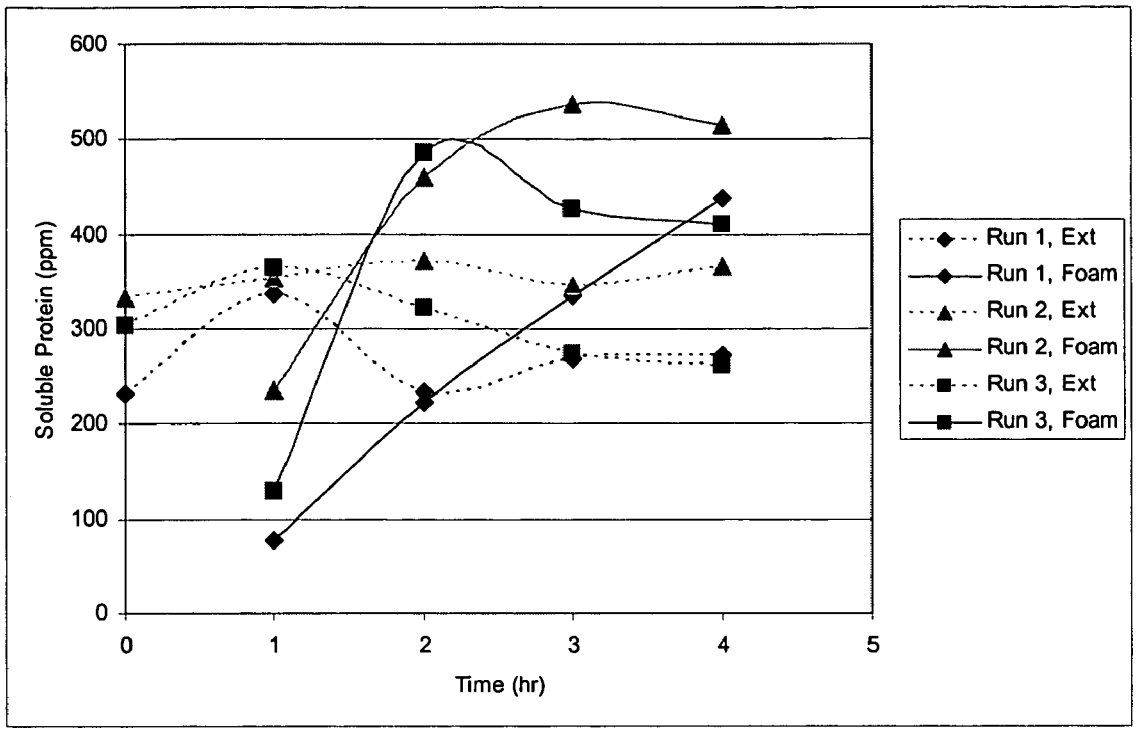
FIG. 3 is a graph showing soluble protein concentration for extract (ext) and foamate (foam) samples collected during three trials of the foamate fractionator.

FIG. 3 shows the soluble protein concentrations in the extract and foamate during the four hour test for each run. After four hours (T4), the foamate was enriched 35 to 89%. The variability in these results is due to how the foam is collected. Foam is collected at the top of each unit. Collapsed foam drains out the port into a graduated cylinder. Because the foam does not consistently collapse and drain, and often coats the housing and drain tubing, quantitative assessment of the foamate is less than optimal. The extract did not show a dramatic change in soluble protein concentration due to the relative amounts of extract and foamate. During the four hours, less than a liter of foamate was collected versus over 100 L of extract. In all three runs, the soluble protein level for the sample collected at time one hour (T1) is greater than at time zero. Using T1 as the starting level, the relative concentrations at T4 range from 72% to 104%. The results demonstrate soluble protein removal from the tobacco extract by the foam fractionator.

Foam fractionation successfully removed soluble proteins from aqueous tobacco extract. In the discard fraction, enrichment of approximately two-fold was achieved. Reductions of almost 30% were measured in the processed extract, demonstrating the use of foam fractionation as a physical means of removing proteins from tobacco extract.

EXAMPLE 2

Next, optimization of processing parameters to achieve a 50% reduction in soluble proteins was determined by investigating tobacco batch size and air flow rate. The optimum batch size was determined to be a 25% ratio of tobacco to water. The greatest reduction in soluble protein in the extract was measured at an air flow rate of 5.0 L/min. Foam generation rate, which is related to air flow rate, is also a critical factor. Using a combination of theoretical derivations and empirical results, the time to achieve a desired protein reduction in the extract for a given enrichment was modeled. This experiment tested the model by controlling the foam generation rate for a fixed batch size and air flow rate.

The foam fractionator as previously described was used. For the batch size studying, extracting 10.4 kg of a 50/50 mix of FS and BS is defined as a full batch. Additional sizes of 10% (tenth), 25% (quarter), and 50% (half) of full batch sizes were processed. All batches were extracted in 113.5 L of water at 71° C. for 30 minutes. The liquid was separated from the solid tobacco material with a basket centrifuge. The extract was recirculated through the foam fractionator and samples of the extract and foamate (i.e., collapsed foam) were collected every hour.

Figure 4:
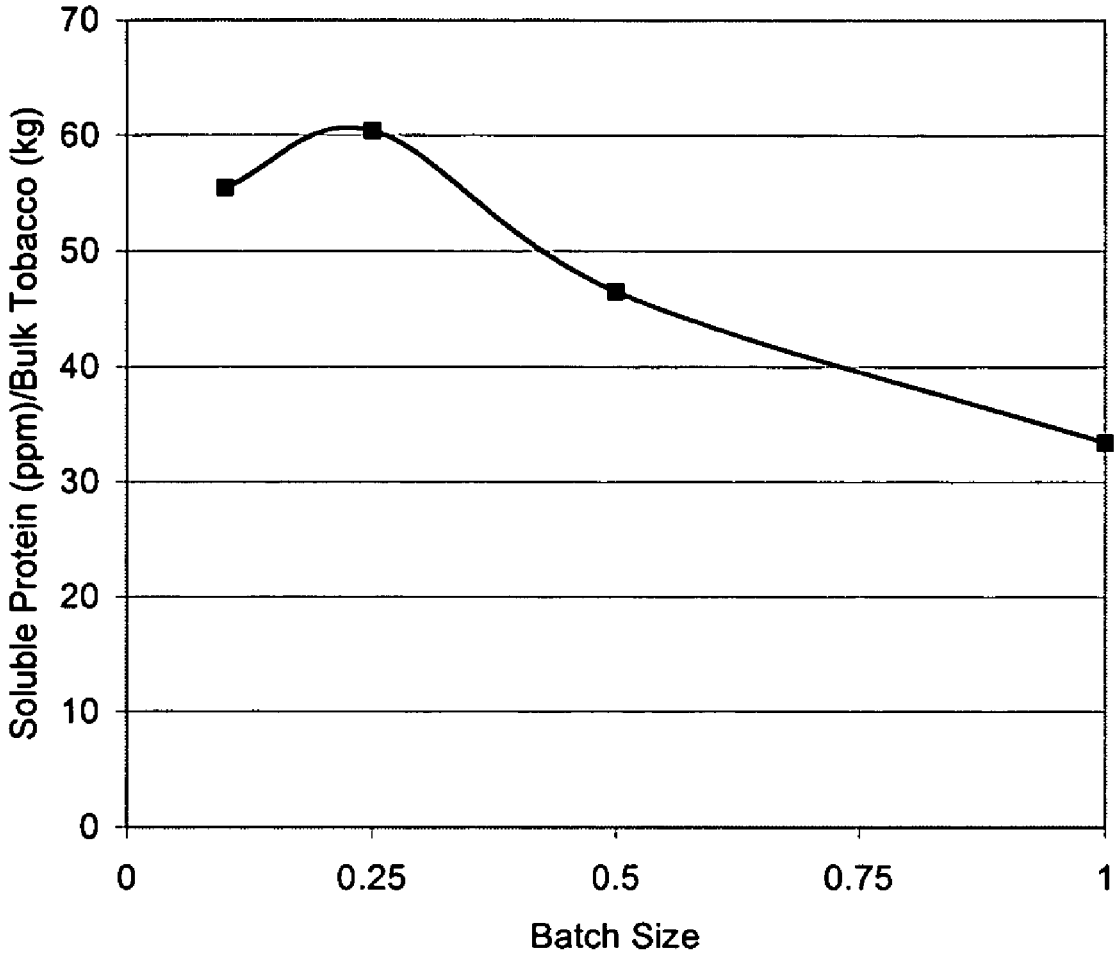
FIG. 4 is a graph showing soluble protein extract efficiency (ppm soluble protein/kg tobacco) at four batch sizes.
Figure 5:
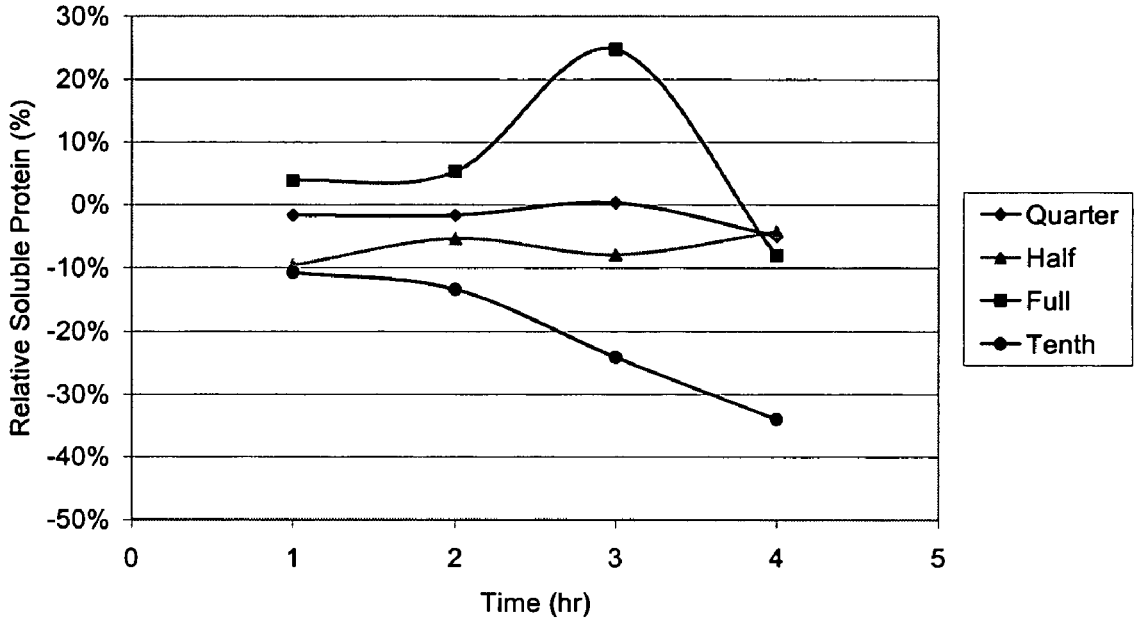
FIG. 5 is a graph showing the relative soluble protein levels for extract at four different batch sizes.
Figure 6:
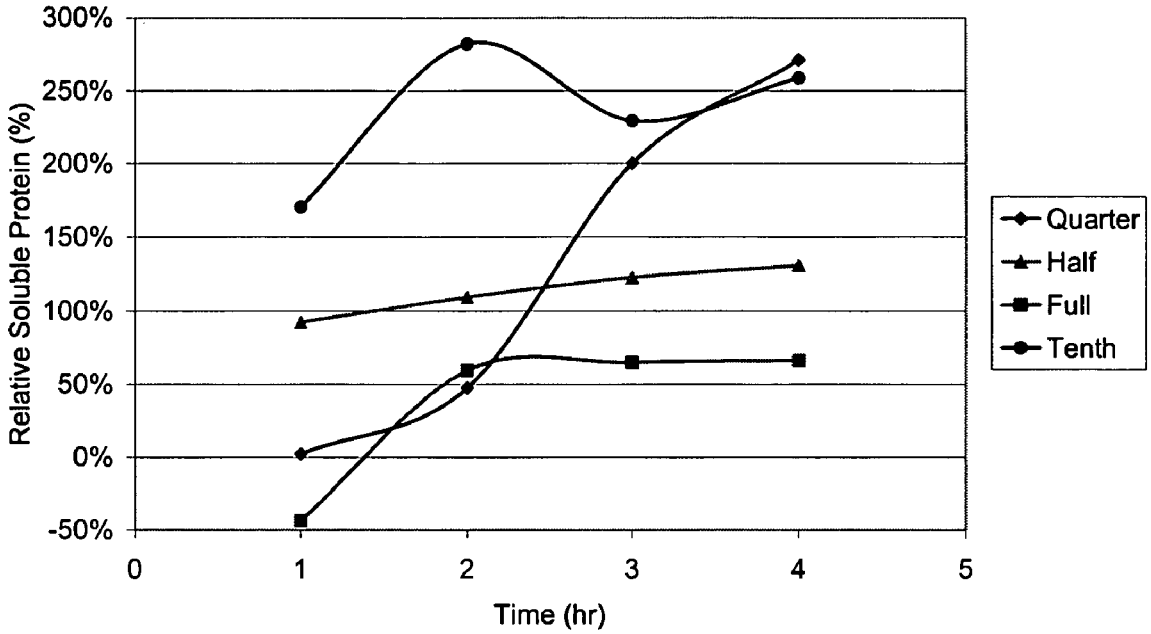
FIG. 6 is a graph showing the relative soluble protein levels for foamate at four different batch sizes.

Referring again to FIG. 2, the optimization parameters are the extract concentration (related to batch size), air velocity and bubble size (related to volumetric air flow), and the extract pool 34 and foam heights 32 (related to foam generation rates). FIG. 4 shows the soluble protein extraction efficiency for the four batch sizes tested. The smaller batch sizes were more efficient at extracting the soluble proteins. FIG. 5 and FIG. 6 show the soluble protein concentrations in the extract and foamate during the four hour test for each batch size tested. After four hours, the amount of soluble protein in the extract was reduced from 4% to 34%. The foamate was enriched from 66% to 271%. With respect to extraction efficiency and foamate enrichment, the one-quarter and one-tenth batch sizes are comparable. One-quarter batch size is preferred as a compromise of maximizing concentration without sacrificing performance.

Figure 7:
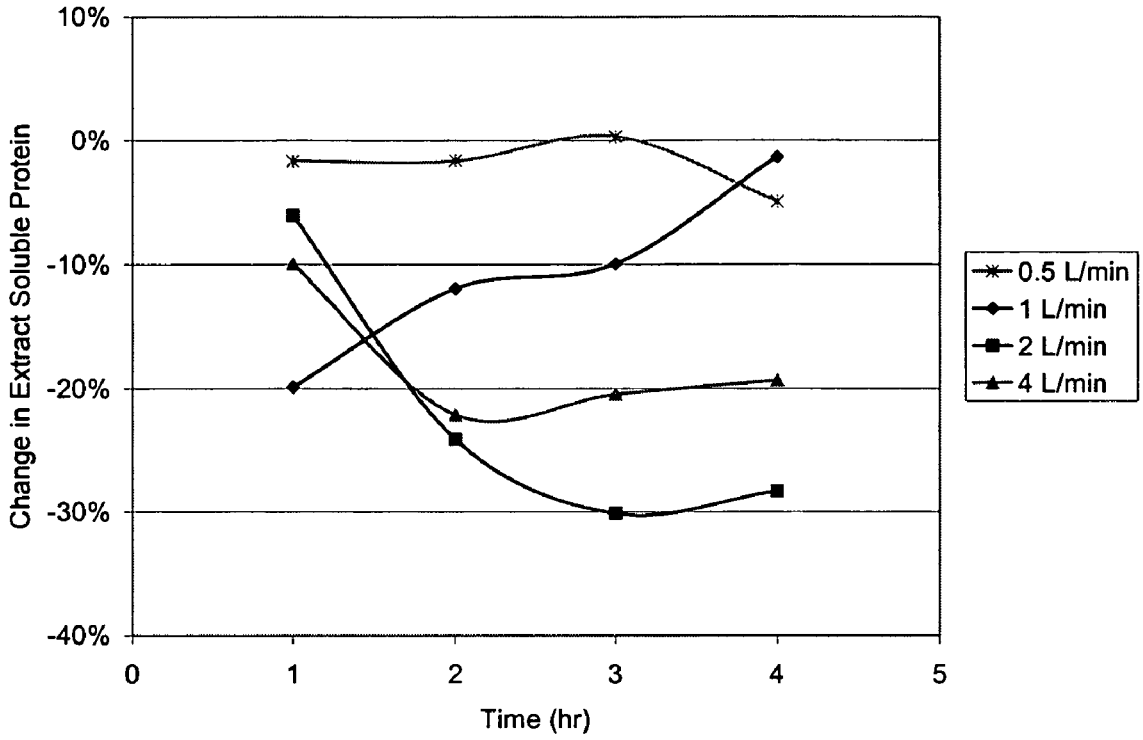
FIG. 7 is a graph showing relative soluble protein levels for extract at four different air flow rates.
Figure 8:
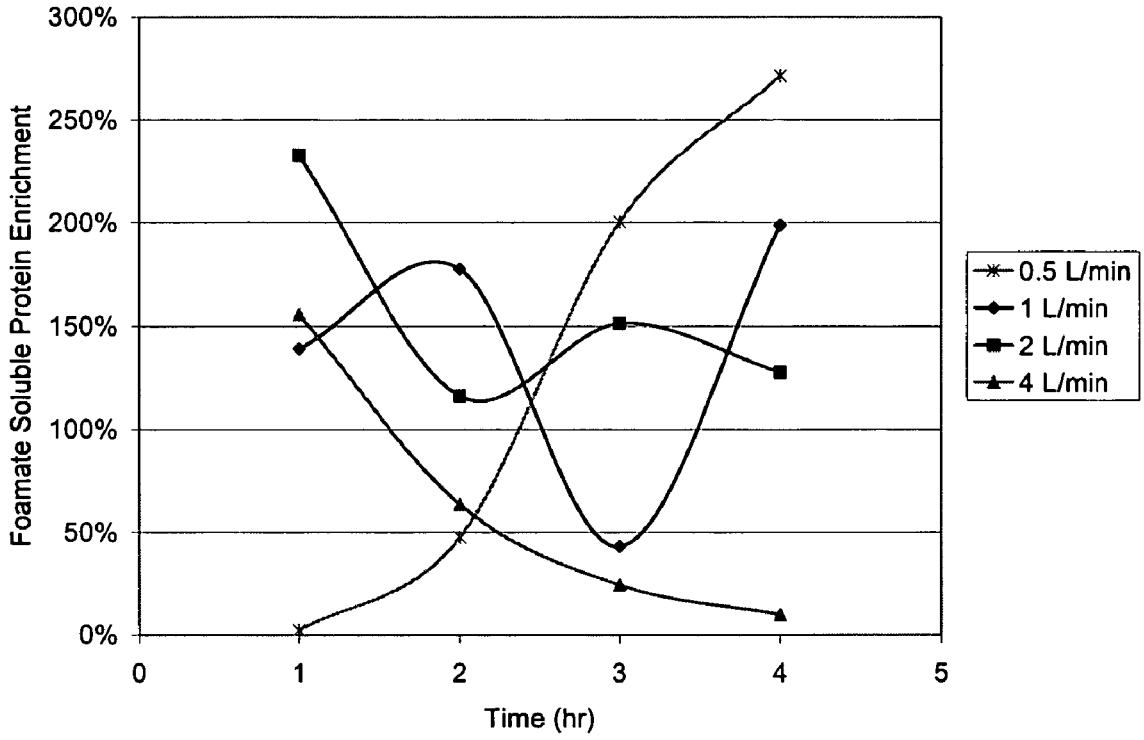
FIG. 8 is a graph showing relative soluble protein levels for foamate at four different air flow rates.
Figure 9:
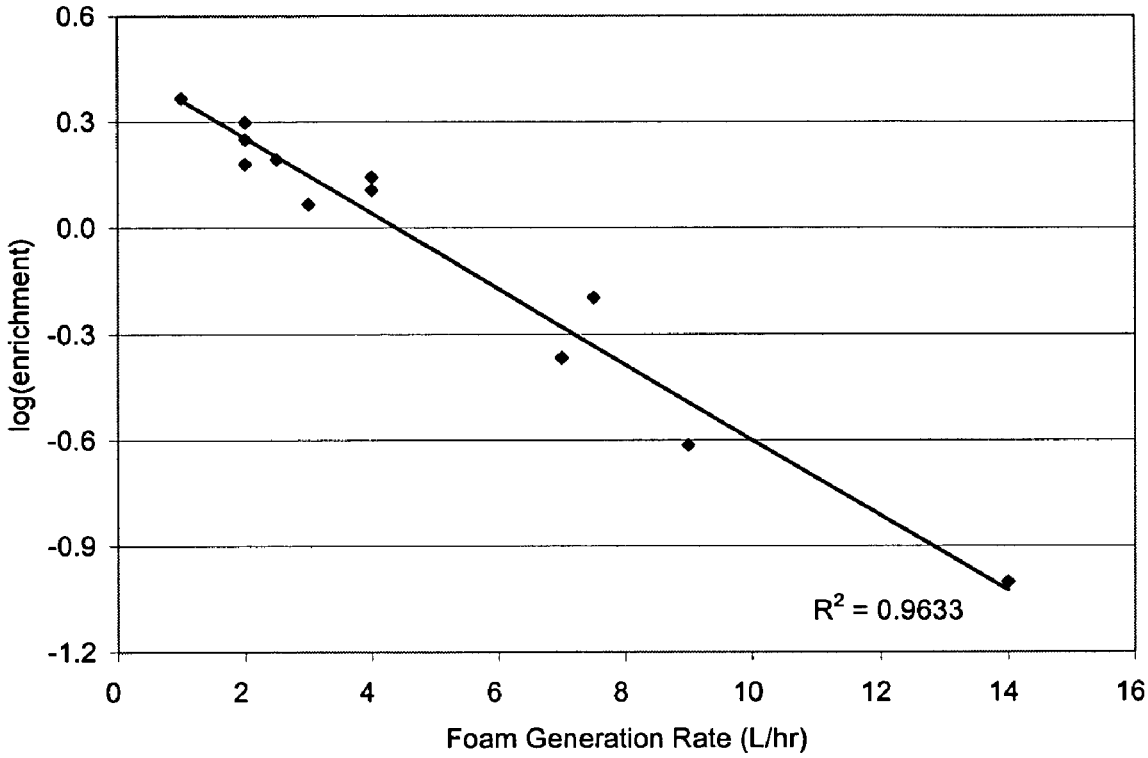
FIG. 9 is a graph showing foamate generation rate versus enrichment for air flow rate experiments.

Referring now to FIG. 7 and FIG. 8, there is shown the results from the air flow experiments for relative soluble protein levels in the extract and foamate, respectively. Similar to the batch size experiments, the inconsistency in the shape of the curves is due to not controlling all the variables, specifically in the foamate generation rate. FIG. 9 shows the trend associated with foamate generation rate. As expected, the slower the generation rate, the greater the enrichment. The slower rates allow more time for the liquid held up in the space between the bubbles to drain, thus reducing the dilution of the protein adsorbed onto the bubble surface. Based on the reduction of soluble protein in the extract, the air flow rate of 2.0 L/min was selected.

A combined theoretical model was developed from the results. Starting from mass balance equations, the foamate volume, $V_f$, relationship to soluble protein reduction in the extract, r, foamate enrichment, $e_t$, and initial extract volume, $V_0$, is $$V_f = \frac{V_0(1-r)}{e_t}.$$

Figure 10:
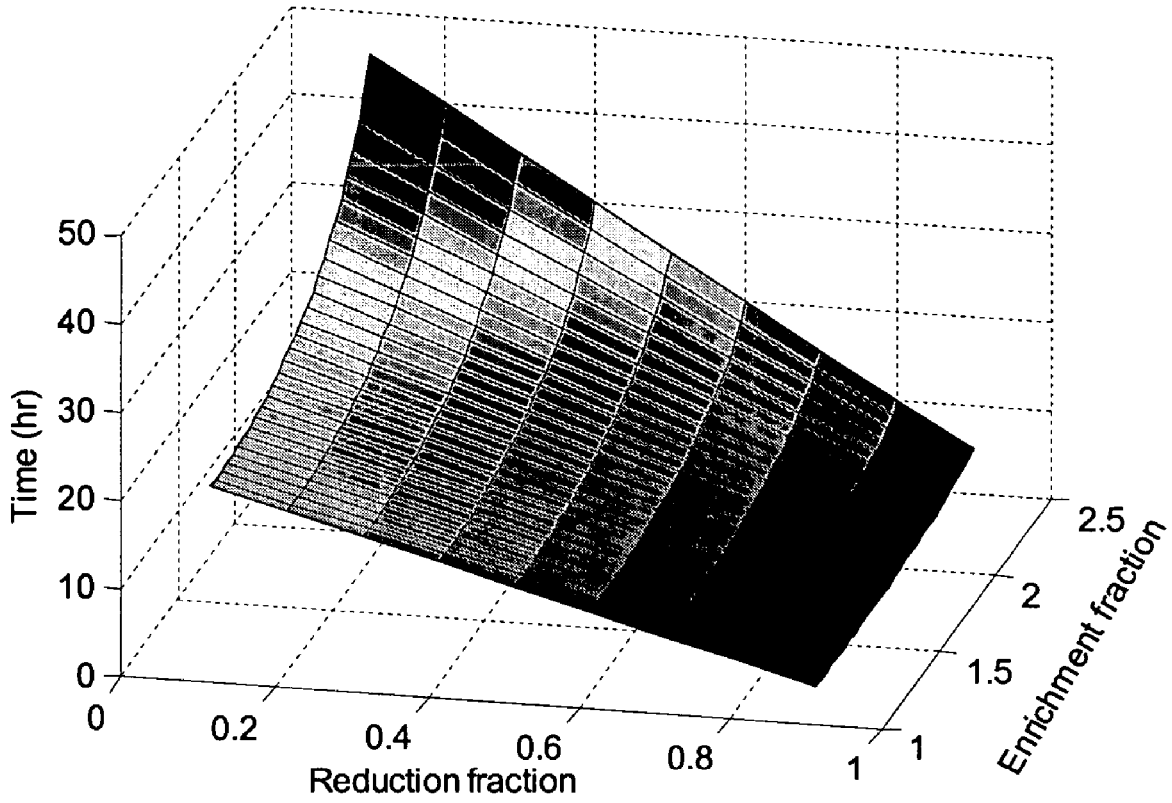
FIG. 10 is a surface plot describing the amount of time needed to achieve a specific reduction in the extract at a given foamate enrichment.

Using the relationship shown in FIG. 9, the amount of time needed to generate the foamate volume at a given enrichment can be calculated. The model defines a response surface, as shown in FIG. 10, for the amount of time needed to achieve a specified soluble protein reduction in the extract at a given foamate enrichment and an initial extract volume of 100 L.

The foregoing detailed description is given primarily for clearness of understanding and no unnecessary limitations are to be understood therefrom, for modifications will become obvious to those skilled in the art upon reading this disclosure, and may be made without departing from the spirit of the invention and scope of the appended claims.

What is claimed is:

1. A process for removing Hoffman analyte precursors from tobacco, comprising the steps of:

soaking tobacco in a solvent to form a soluble portion;

separating said soluble portion into an aqueous tobacco extract and an insoluble fibrous portion;

subjecting said aqueous tobacco extract to a foam fractionation system;

bubbling a gas though said aqueous tobacco extract in said foam fractionation system to form bubbles, wherein said Hoffman analyte precursors preferentially adsorb to a gas-liquid interface of said bubbles as said bubbles move though said aqueous tobacco extract, and wherein said bubbles accumulate to form a column of foam on top of said aqueous tobacco extract, said foam having said Hoffman analyte precursors preferentially adsorbed thereto; and moving said foam into a foam collector, wherein said foam collapses yielding a foamate enriched with said Hoffman analyte precursors.

2. The process of claim 1, wherein said solvent is selected from the group consisting of water, distilled water, tap water, deionized water, water-miscible solvents, and combinations thereof.

3. The process of claim 1, wherein said tobacco is comprised of tobacco particles selected from the group consisting of natural tobacco stems, flue cured scrap tobacco and stems, burley cured scrap tobacco, fines, tobacco byproducts, reconstituted tobacco, tobacco extracts, and combinations and blends thereof.

4. The process of claim 1, wherein said tobacco is soaked in said solvent at a temperature of from about 63° C. to about 100° C. for at least about 30 minutes.

5. The process of claim 1, wherein said tobacco and said solvent are in a ratio of from about 1:100 to about 1:10.

6. The process of claim 1, wherein said aqueous tobacco extract has dissolved solids from about 0.5% to about 10.0% by weight.

7. The process of claim 1, further comprising adjusting the pH of said soluble portion within the range of from about 3 to about 10 prior to separating said soluble portion.

8. The process of claim 1, further comprising adjusting the pH of said aqueous tobacco extract within the range of from about 3 to about 10 prior to subjecting said aqueous tobacco extract to said foam fractionation system.

9. The process of claim 1, further comprising treating said aqueous tobacco extract with chelates, activated charcoals, clays, ion exchange resins, molecular imprinted polymers, surfactants, and combinations thereof, prior to subjecting said aqueous tobacco extract to said foam fractionation system.

10. The process of claim 1, wherein said gas is selected from the group consisting of air, nitrogen, ozone, oxygen, ammonia, and combinations thereof.

11. The process of claim 1, wherein said gas is injected into said foam fractionation system at a flow rate of from about 0.5 liters per minute to about 5.0 liters per minute.

12. The process of claim 1, further comprising recirculation of said foamate.

13. The process of claim 12, wherein said recirculation occurs through a series of foam fractionators, each of said foam fractionators uniquely configured for protein removal optimization.

14. The process of claim 1, further comprising recirculation of said aqueous tobacco extract after it has been subjected to said foam fractionation system.

15. The process of claim 14, wherein said aqueous tobacco extract, after being separated from said soluble portion, is treated with chelates, activated charcoals, clays, ion exchange resins, molecular imprinted polymers, surfactants, and combinations thereof, during said recirculation.

16. The process of claim 14, wherein said recirculation occurs through a series of foam fractionators, each of said foam fractionators uniquely configured for protein removal optimization.

17. The process of claim 1, wherein after separation from said aqueous tobacco extract said insoluble fibrous portion is manipulated to form a tobacco sheet material.

18. The process of claim 17, wherein said aqueous tobacco extract is applied to said tobacco sheet material after subjecting said aqueous tobacco extract to said foam fractionation system.

19. A process of separating proteins from tobacco containing proteins employing foam fractionation, comprising the steps of:

soaking tobacco in an aqueous solvent to form a tobacco slurry;

extracting said tobacco slurry to form an aqueous tobacco extract and an insoluble fibrous portion;

introducing said aqueous tobacco extract into a foam fractionator;

introducing gas bubbles into said foam fractionator to bubble though said aqueous tobacco extract, wherein said proteins preferentially adsorb to a gas-liquid interface of said bubbles, and wherein said bubbles accumulate on top of said aqueous tobacco extract to form a foam;

allowing said foam to collapse and yield a foamate enriched with said proteins; and removing said foam containing said proteins from said foam fractionator.

20. The process of claim 19, wherein said solvent is selected from the groups consisting of water, distilled water, tap water, deionized water, water-miscible solvents, and combinations thereof.

21. The process of claim 19, wherein said tobacco is comprised of tobacco particles selected from the group consisting of natural tobacco stems, flue cured scrap tobacco and stems, burley cured scrap tobacco, fines, tobacco byproducts, reconstituted tobacco, tobacco extracts, other tobacco containing material, and combinations and blends thereof.

22. The process of claim 19, wherein said tobacco is soaked in said solvent at a temperature of from about 63° C. to about 100° C. for at least about 30 minutes.

23. The process of claim 19, wherein said tobacco and said solvent are in a ratio of from about 1:100 to about 1:10.

24. The process of claim 19, wherein said aqueous tobacco extract has dissolved solids from about 0.5% to about 10.0% by weight.

25. The process of claim 19, further comprising adjusting the pH of said tobacco slurry within the range of from about 3 to about 10 prior to separating said tobacco slurry.

26. The process of claim 19, further comprising adjusting the pH of said aqueous tobacco extract within the range of from about 3 to about 10 prior to introducing said aqueous tobacco extract into said foam fractionator.

27. The process of claim 19, further comprising treating said aqueous tobacco extract with chelates, activated charcoals, clays, ion exchange resins, molecular imprinted polymers, surfactants, and combinations thereof, prior to introducing said aqueous tobacco extract into said foam fractionator.

28. The process of claim 19, wherein said gas bubbles are formed by injecting a gas into said foam fractionator, said gas selected from the groups consisting of air, nitrogen, ozone, oxygen, ammonia, and combinations thereof.

29. The process of claim 28, wherein said gas is injected at a flow rate of from about 0.5 liters per minute to about 5.0 liters per minute.

30. The process of claim 19, further comprising recirculation of said foamate.

31. The process of claim 30, wherein said recirculation occurs through a plurality of foam fractionators, each of said foam fractionators uniquely configured for protein removal optimization.

32. The process of claim 19, further comprising recirculation of said aqueous tobacco extract after it has been introduced into said foam fractionator.

33. The process of claim 32, wherein said aqueous tobacco extract is treated with chelates, activated charcoals, clays, ion exchange resins, molecular imprinted polymers, surfactants, and combinations thereof, during said recirculation.

34. The process of claim 32, wherein said recirculation occurs through a plurality of foam fractionators, each of said foam fractionators uniquely configured for protein removal optimization.

35. The process of claim 19, wherein after extraction of said tobacco slurry said insoluble fibrous portion forms a tobacco sheet material.

36. The process of claim 35, wherein said aqueous tobacco extract is applied to said tobacco sheet material after subjecting said aqueous tobacco extract to said foam fractionator.

* * * * *